US006276257B1

(12) United States Patent
Hellemann

(10) Patent No.: US 6,276,257 B1
(45) Date of Patent: Aug. 21, 2001

(54) WORKING CYLINDER, SWITCH VALVE AND PRESSURE-ACTUATED WORKING UNIT

(75) Inventor: Alfredo Hellemann, Schongau (DE)

(73) Assignee: Hygrama AG, Schongau (DE)

( * ) Notice: Subject to any disclaimer, the term of this patent is extended or adjusted under 35 U.S.C. 154(b) by 0 days.

(21) Appl. No.: 09/366,725

(22) Filed: Aug. 4, 1999

(30) Foreign Application Priority Data

Aug. 4, 1998 (AT) ..... A 1344/98

(51) Int. Cl.[7] ..... F01B 3/00; F15B 4/08
(52) U.S. Cl. ..... 91/442; 91/469; 92/164
(58) Field of Search ..... 91/442, 443, 468, 91/469, 463, 404, 405; 92/164

(56) References Cited

U.S. PATENT DOCUMENTS

| | | | | |
|---|---|---|---|---|
| 2,640,368 | * | 6/1953 | Schjolin | 91/433 X |
| 3,010,435 | * | 11/1961 | Abrams | 91/443 |
| 3,202,060 | * | 8/1965 | Grotness | 91/443 |
| 4,187,764 | * | 2/1980 | Cho | 91/442 |
| 4,393,751 | * | 7/1983 | Kelley | 91/442 X |
| 4,700,611 | * | 10/1987 | Kaneko | 91/443 X |
| 6,135,906 | * | 10/2000 | Ichida | 91/442 X |

* cited by examiner

*Primary Examiner*—John E. Ryznic
(74) *Attorney, Agent, or Firm*—Dykema Gossett PLLC

(57) ABSTRACT

A working cylinder (A) having at least one working chamber (6, 7) defined by the cylinder barrel (1), at least one of the end sections (2, 3) and a piston (4), at least one supply port (9*a*, 9*b*) and a exhaust port (12*a*, 12*b*) for the working medium. The exhaust port (12*a*, 12*b*) has a valve (13*a*, 13*b*) that may be regulated by the pressure of the working medium, which is applied at the supply port (9*a*, 9*b*) in order to obtain a smaller dimension of at least the valve and to better utilize the already existing space, specifically within the cylinder, and to better and more efficiently adjust the output capacity of the individual elements. A valve (V), particularly a switch valve (W) of a rocker valve design has therefore at least one inlet (16) and at least one outlet (17*a*, 17*b*) for the working medium, as wells as at least one control port (18). The cylinder is characterized by a discharge channel (19, 19*a*; 38*a*, 38*b*) for the working medium, originating from a location between the valve element (15; 31, 33) of the valve and at least one outlet (17*a*, 17*b*), whereby this discharge channel has a discharge or exhaust valve (20, 22; 36*a*, 36*b*), which may be regulated electrically or by the pressure applied to the control port. The pressure-actuated working unit comprises a pneumatic working cylinder (A) with exhaust valves (27*a*, 27*b*), a valve (V, W) and exhaust control valves (24*a*, 24*b*; 30) as well as only one pressure line (29*a*, 29*b*) to each working chamber (6, 7) in the cylinder (A).

9 Claims, 5 Drawing Sheets

WORKING CYLINDER, SWITCH VALVE AND PRESSURE-ACTUATED WORKING UNIT

BACKGROUND AND SUMMARY OF THE INVENTION

This invention relates to a working cylinder having a working chamber defined by a cylinder barrel, at least one of the end sections and a piston, at least one supply port for the working medium for this working chamber, an exhaust port for the working medium from this working chamber, a valve, specifically for controlling this type of working cylinder; at least one inlet and one outlet for a work medium; at least one control port or a switch valve, specifically for controlling a double-action working cylinder; at least one connector and at least two outlets for a working medium; at least one control port; a working unit, including at least one compression source for the working medium; at least one and at the most a double-action working cylinder; at least one valve for controllable supply of the working cylinder with a working medium; and at least one line for the working medium from the valve to the working cylinder.

Multiple functions are necessary for the conversion of pneumatic energy to mechanical power, for example, whereby these functions are performed by various components, elements or group of components of the pneumatic working units in this case. Thereby the signal to move forward is converted into an air pressure signal of the corresponding working chamber in the working cylinder and possibly convert it to a depressurizing signal of the opposed chamber or these signals are to be combined. This is accomplished in traditional designs by a valve, which also takes care of conversion of the compressed air network in the corresponding working chamber, opening of the opposed chamber to depressurize the cylinder, and discharge of the outgoing air into the atmosphere. The line as well as the compressed air network to the cylinder are pneumatic lines, which only take care of the conversion of air pressure to mechanical power through the cylinder piston and the discharge of air from the cylinder into the atmosphere. Up to now, pneumatic cylinders were pressurized and depressurized through the same lines even though these two functions required different diameters. Valves use up to now for the control of double-action pneumatic cylinders had to be designed large in size because their function and the diversion of the pressure medium into the corresponding cylinder chamber and also because of the depressurization control of each opposed chamber whereby a large amount of space remained unused at the end sections of the pneumatic cylinders. The situation was similar for hydraulic units.

The object of the present invention is therefore to create elements for a pressure-actuated working unit and to create an improved working unit of this type in itself, whereby a smaller size in design of at least the valve is obtained, the already existing space in the cylinder is better utilized and the output capacity of the individual elements is adjusted better and more efficiently.

This object is reached primarily with a working cylinder of the above-mentioned type, according to the invention, in that the cylinder exhaust port has a valve, which may be regulated by the pressure of the working medium at the supply port. Thereby, for example, a component group for a function of the pressure-actuated pneumatic working unit is moved from the valve into the working cylinder, preferably into its end section, where there is already sufficient space for the corresponding component without the need for larger dimensions. Therefore, the valve itself may be made smaller because of the elimination of components necessary for discharge or depressurization control.

Further improved space utilization is accomplished, according to an advantageous embodiment, in that the supply port and the exhaust port are directly connected to one another by a passageway for the working medium, whereby the valve is installed inside this passageway.

Optimal space utilization within the working cylinder is possible if a supply channel to the work area leads from the supply port for the working medium, parallel to the passageway, and subsequently to the exhaust port.

In order to satisfy the different requirements for pressurizing and depressurizing or for supplying and discharging of the working medium, it is advantageously planned that the supply channel has a smaller diameter than the passageway to the exhaust port. Now the pressurizing or supplying of the working medium may be accomplished in a simple way without additional structural efforts by better using the smaller diameter channel and by using the optimal larger diameter channel for depressurizing the working cylinder or for discharging the working medium.

Requirements may be solved in an advantageous manner and in a simple design concerning noise protection in case of pneumatic systems or concerning the flow phenomenon in case of hydraulic systems, by topping the exhaust port with a speed throttle element and/or a muffler.

According to an advantageous embodiment of the invention, the valve has in its design a sealing element that moves freely and covers the passageway and which also covers the supply channel at least partly.

Thereby there has been realized, in a simple and very functional manner, the above-mentioned control for depressurizing dependent on pressurizing or discharge of the working medium dependent on applying pressure to the working chamber of the cylinder.

The innovative construction of the working cylinder is especially advantageous if it is designed as a double-action cylinder and if it is preferably made at each side as shown in the above-mentioned paragraph and by being the same at both sides, at least functionally, thereby the mentioned advantages are twice as much, meaning advantages for both sides are taken into consideration.

The first-mentioned valve, which is particularly meant to be used for the control of the innovative pneumatic working cylinder, is identified according to an additional characteristic of the invention by an exhaust channel for the working medium, originating from a location between the throttle element of the valve and at least one outlet, whereby there is located an adjustable discharge or depressurizing valve within this exhaust channel, which may be adjusted by the pressure that is applied at the control port. This channel may be placed within the valve housing itself or in one of the elements within the valve and this causes thereby no increase in its dimensions. The valve must therefore be only large enough to contain the absolutely necessary connections and control elements so that optimal functioning is reached with the smallest structural dimension.

As firstly described, there is a switch valve designed for the double-action working cylinder, characterized by at least one exhaust channel for each cylinder located between the valve element and each outlet, whereby there is located in each exhaust channel at least one adjustable discharge or exhaust control valve that has pressure applied at the control port. Thereby, the same advantages have been reached as mentioned for the previous arrangement, whereby the air net connection or the connection for the source of the pressure medium must be connected alternately to one of the two working cylinders. The same is true, in principle, for an electric adjustable discharge or exhaust valve.

According to an especially advantageous embodiment, there is a switch valve designed as a rocker valve, which has a switchable rocker seal element between two switching positions that has pressure applied to the control connection so that the discharge or exhaust control valve remains in an effective connection with the control area through at least one device for transferring the pressure that is applied to the control port. With this type of design there is guaranteed an immediate safe and rapid depressurizing control or control for exhaust of the pressure medium from the working cylinder by having the smallest wasted space, allowing rapid switching even with large port diameters, and keeping a tight seal. Based on the small pivoting movement of the rocker, which is sufficient for the switching action, the innovative valve may be built in a very small and flat shape and may be built in layered sections that allow easy operating, easy repair and assembly. With the innovative design of the switch valve, a smaller size in construction has been reached as compared even with two rocker valves for a 5/2-way function.

A flexible membrane is advantageously planned that is a part of the wall in the control area and which serves as a device for transferring pressure to actuate the actual sealing element through a valve shaft. This sealing element thereby blocks or opens the discharge channel. This ensures a very good switching capability of the discharge or exhaust valve in a structural simple and space-saving manner.

As a matter of course, the above mentioned advantages may be doubled by optimal utilization of the existing spaces, which applies to both sides for which control is necessary and where the switch valve has at least the same functional design at both sides.

The innovative pneumatic working unit includes at least one pressure source for the working medium, at least one pneumatic working cylinder, at least one valve for the controllable supply of the working cylinder with a working medium, at least one line for the working medium from the valve to the working cylinder. It is characterized by better space utilization and downsizing or decreasing of components as well as better power adjustment of the elements. It is also characterized in that there is only one line to the cylinder per cylinder working chamber carrying the working medium, the lines may be depressurized or the pressure may be reduced by the use of at least one switchable discharge or exhaust valve, the working cylinder is designed according to at least one of the above-mentioned paragraphs and whereby its exhaust port is kept open.

It is planned, for example, that pressure be applied to the control port of the discharge or exhaust valve to reach the best possible and structural most simple combination of pressurizing and depressurizing function or supplying and discharging of the working medium.

In a preferred way, and to reach the above-mentioned advantages, the working unit is characterized by a valve arrangement which has a exhaust channel for the working medium that originates at a location between the shut-off element of the valve and at least one outlet and whereby there is located in this exhaust channel a discharge or exhaust valve that is controlled by the pressure applied at the control port.

The pneumatic working unit, which has at least one double-action pneumatic working cylinder, is characterized according to one advantageous version in that there is one line per working cylinder carrying the working medium, that the working cylinder corresponds to at least one of the related paragraphs, and that one switch-valve arrangement corresponds to at least one of the above related paragraphs.

According to an additional invention characteristic, there is a control logic arrangement, which has connectors for communication (preferably a field bus), electrical control and supply for the working medium. Thereby a more compact size of the working unit is possible even at increased versatility.

According to another characteristic of the invention, the valve to control one or both working chambers of the working cylinder may of course be directly attached to it or integrated within, preferably in one of the end sections of the cylinder.

One or each exhaust control valve may also be advantageously attached to the working cylinder or the switch valve or may be structural integrated within. In both cases, there is far reaching simplification in assembly and arrangement at the assembly point. Furthermore, lines may be eliminated between these assembled components and in case of structural integration, connections and sealing areas may also be eliminated, whereby, on the one hand, the arrangement of the entire system is greatly simplified and, on the other hand, its operational dependability may be increased considerably based on less danger of leakage. The just-mentioned possibilities may also be applied advantageously in the design of the switch valve in its rocker type construction.

Some design examples of pneumatic versions are explained in more detail in the subsequent description as they relate to the attached drawings, whereby these examples are not to be evaluated in any way as limitations to the general innovative idea encompassed by the accompanying claims.

DETAILED DESCRIPTION OF THE PREFERRED EMBODIMENTS

Figure 1:
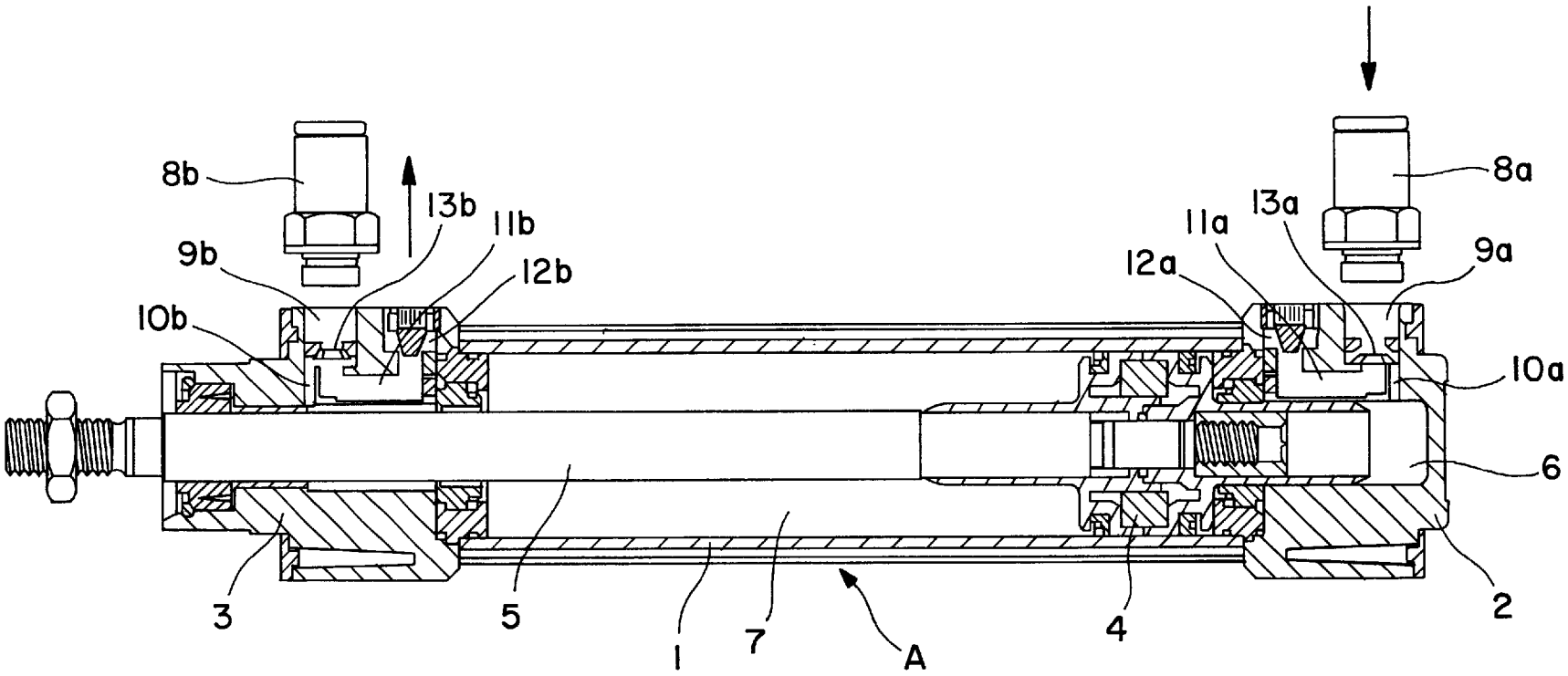
FIG. 1 shows a sectional view of a preferred embodiment of the inventive working cylinder.

The pneumatic working cylinder A illustrated in FIG. 1, actuated preferably by compressed air as a working medium, consists of a cylinder barrel 1, which ends are closed off with a rear cover 2 and a front cover 3. A movable piston 4 is placed into this working cylinder A. The piston transfers the mechanical force onto the element to be powered through a piston rod 5, which runs through the front cover 3 while maintaining a seal. The invention may of course also be applied in the same manner to cylinders without piston rods and working mediums other than compressed air, for example: hydraulic working mediums.

The first working chamber 6 is defined between the rear cover 2 and the piston 4 of the illustrated double-action working cylinder A and the second working chamber 7 is defined between the front cover 3 and the piston 4, whereby according to the supply of working medium and depressurization, the working chamber in the movement of the piston 4 represents a depressurized opposed chamber in relation to the pressurized temporary working chamber. The compressed air is moved to the working chamber through the ports 8*a* and 8*b*, which are placed in the supply ports 9*a* and 9*b*, whereby the compressed air flows into the working chambers 6 and 7 through the supply channels 10*a* and 10*b*, which have a relative small diameter. Parallel to these supply channels 10*a* and 10*b*, passageways 11*a*, 11*b* lead away from each of the supply ports 9*a*, 9*b*, and these passageways lead to two exhaust ports 12*a*, 12*b* for the air from the working chambers 6,7. No lines are connected to these exhaust ports 12*a*, 12*b*, since they lead directly or preferably through a muffler or a speed regulating throttle with an attached muffler (both vaguely illustrated) into the open atmosphere.

The mouth of the passageway 11*a*, 11*b*, which is located in the supply port 9*a*, 9*b*, forms a valve seat for a preferably flat valve element 13*a*, 13*b*, which is also located in the supply port 9*a*, 9*b*, and this valve element covers the mouth completely and also covers, at least partly, the mouth of the parallel running supply channel 10*a*, 10*b* that leads to the working chamber 6 or 7. Whenever, for example, compressed air is moved into the working chamber 6 through the corresponding port 8*a* (located in the drawing to the right), then the right valve element 13*a* is pushed against its seat and seals subsequently the passageway 11*a* to the right exhaust port 12*a*. The compressed air flows past the valve element 13*a* into the supply channel 10*a* and continues to flow into the working chamber 6. Thereby the piston 4 is pushed in sequence to the left and the piston rod 5 moves outward. If the left port is now without pressure, caused by the exhaust valve, then this piston movement can lift the left valve element 13*b* from its valve seat in the opposed chamber shown as working chamber 7, whereby the passageway 111*b* is opened up and the air from the opposed chamber may now flow through the exhaust port 12*b* into the atmosphere.

In reverse, as soon as the right port 8*a* is without pressure and the left port 8*b* is supplied with compressed air, then the conditions are reversed and the left valve element 13*b* seals off the passageway 11*b* so that the compressed air is only forwarded into the working chamber 7. At the opposite side, the air that had been pushed back is now pushing from the opposed chamber 6 and lifts the valve element 13*a*. As soon as the port 8*a* is without pressure, then the air is able to escape through the passageway 11*a* and the exhaust port 12*a*. Other valve designs might make sense and might be necessary for liquid working mediums, which however does not change the principle of the invention or its functioning.

Figure 2:
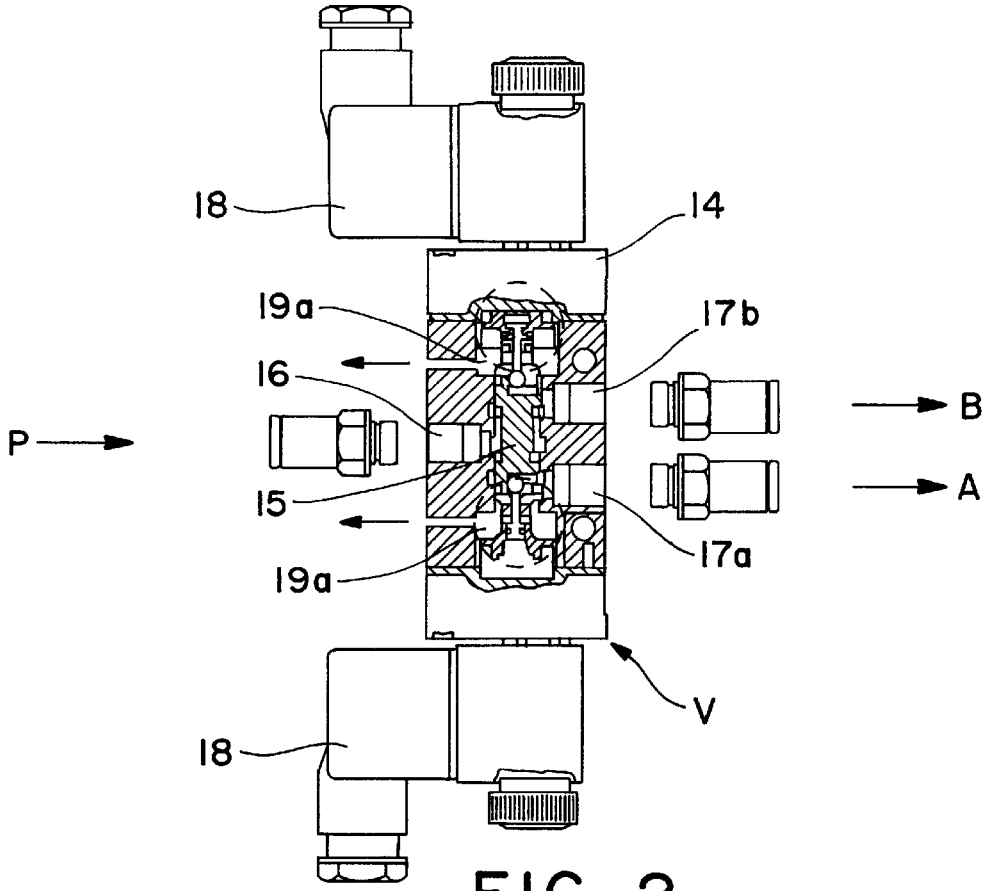
FIG. 2 is a partial, cross-sectional illustration of an inventive switch valve with integrated exhaust control valves.

With the use of this type of working cylinder A, which has integrated pressure release or exhaust, the exhaust valve arrangement may be avoided, as shown in the version in FIG. 2, for example, and the component may be reduced in size correspondingly. The actual valve element 15 is placed movable within the housing 14 of the valve V, whereby the valve element 15 connects alternatively the compressed air port 16 with both working ports 17*a* and 17*b*, which supply with compressed air the work chambers 6 and 7 of the working cylinder A through pressure lines and connectors 8*a* or 8*b*. Thereby pressure from the control ports 18 is applied to the valve element 15.

Figure 3:
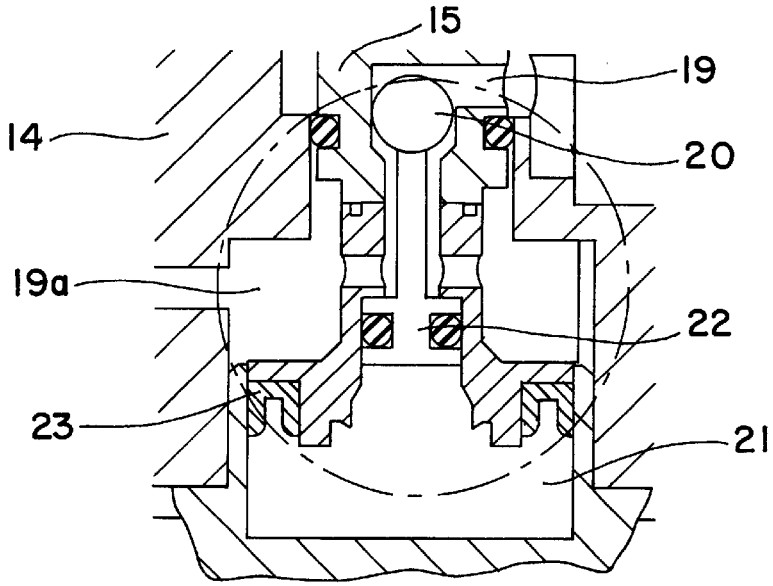
FIG. 3 shows a possible version of the exhaust control valves integrated within the switch valve.

A discharge channel 19 may be designed according to a version of the valve to integrate in simple manner the depressurization control function for the pressure lines to the ports 8*a* or 8*b* at the working cylinder into the valve. This discharge channel 19 may lead from a location between the corresponding outlet 17*a*, 17*b* of valve V and the actual valve element 15 to a exhaust port 19*a* and subsequently into the atmosphere. This discharge channel 19 is closed off by a valve element 20, as long as the corresponding outlet is connected to the compressed air source. As soon as the control signal switches the direction of movement, as shown in FIG. 3, by applying pressure in the areas 21 through the control pressure, then the valve element 20 is lifted from its seat by the valve piston 22 and thereby opens the connection from the discharge channel 19 through the exhaust port 19*a*. The pressure line is thereby depressurized and the valve element 13*a*, 13*b*, previously under pressure by compressed air, in the working cylinder A is also depressurized and the corresponding working chamber is depressurized as well.

Figure 4:
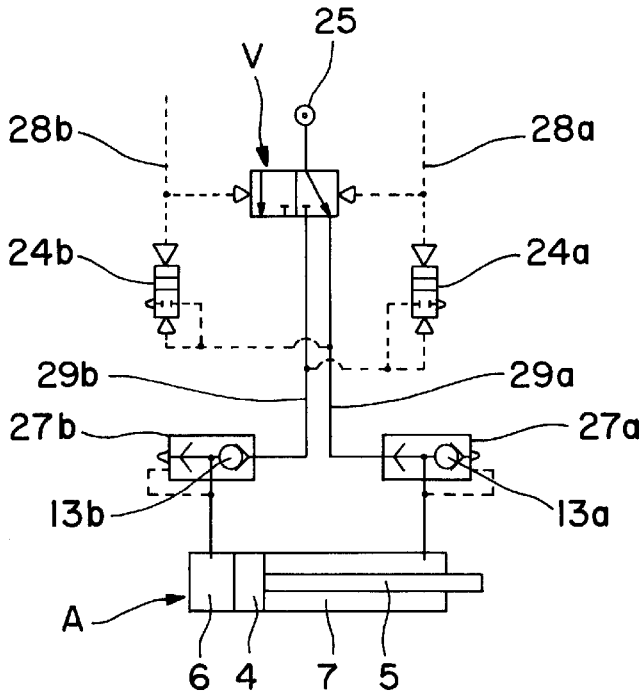
FIG. 4 and FIG. 5 are schematic connection diagrams of inventive pneumatic working units.

The above described depressurization function may of course also be actuated by separate exhaust control valves 24, as it is shown in FIG. 4, whereby the working air line is indicated by solid lines and the control air line is indicated by dotted lines. In the above-shown pneumatic working unit, the compressed air source 25 is connected by a switch valve V to the working cylinder A. The working cylinder A has two integrated depressurization valves 27*a* and 27*b*, for example, as explained in relation to FIG. 1.

The control air lines 28*a*, 28*b* lead to the switch valve V and also to the two depressurization control valves 24*a*, 24*b*, which block or open the discharge lines in the compressed air lines 29*a* and 29*b* to the working cylinder A. Whenever, for example, the right control air line 28*a* is placed under pressure by the control pressure, then the switch valve V opens the compressed air connection to the right working chamber 6 of the working cylinder A. Since the pre-control pressure is applying force also parallel to the right exhaust valve 24*a*, the switch valve is moved at the same time into a position in which the connection of the left compressed air line 29*b* opens into the atmosphere and this line is therefore without pressure. Thereby the depressurization valve 27*b* is being opened and the left working chamber 7 may be depressurized into the atmosphere. The left exhaust control valve 24*b* remains in a closed position since there is no control pressure applied.

Figure 5:
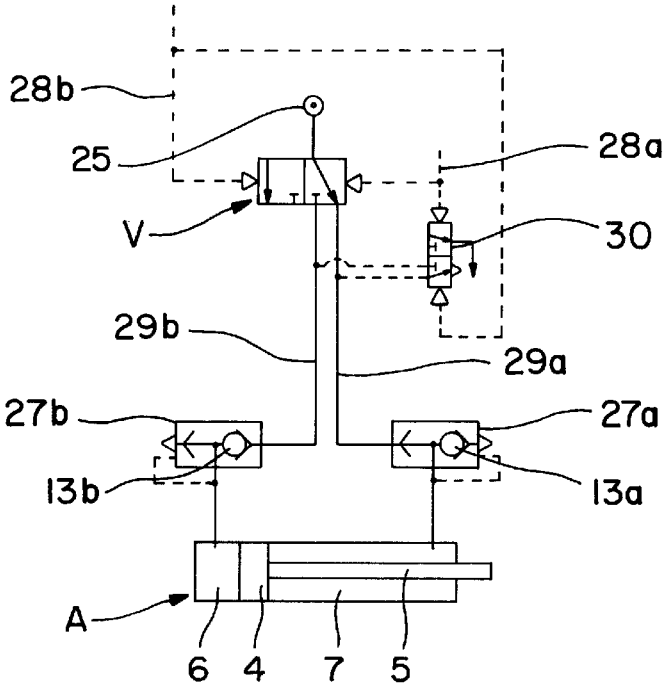

Instead of two exhaust control valves 24*a* and 24*b* as shown in FIG. 5, there can also be a single exhaust control valve 30, whereby both inlets are connected with one of the two pressure lines 29*a* and 29*b* and whereby its outlet leads into the atmosphere. The exhaust control valve 30 is a traditional 3/2-way valve, for example, the same as the switch valve V. Whenever the left control line 28*b* is placed under pressure by the control pressure, the compressed air flows from the compressed air source 25 through the pressure line 29*b* to the left working chamber 7. At the same time, the exhaust control valve is moved into a position by the parallel applied control pressure, in which the right pressure line 29*a* is depressurized through the depressurization control valve 30 into the atmosphere and is thereby with out pressure. Now pressure is released at the right exhaust valve 27*a* in the working cylinder A and the air may escape from the right working chamber 6 through this valve 27*a* and subsequently into the open atmosphere, whereby the right working chamber 6 is now a depressurized opposed chamber.

Figure 6:
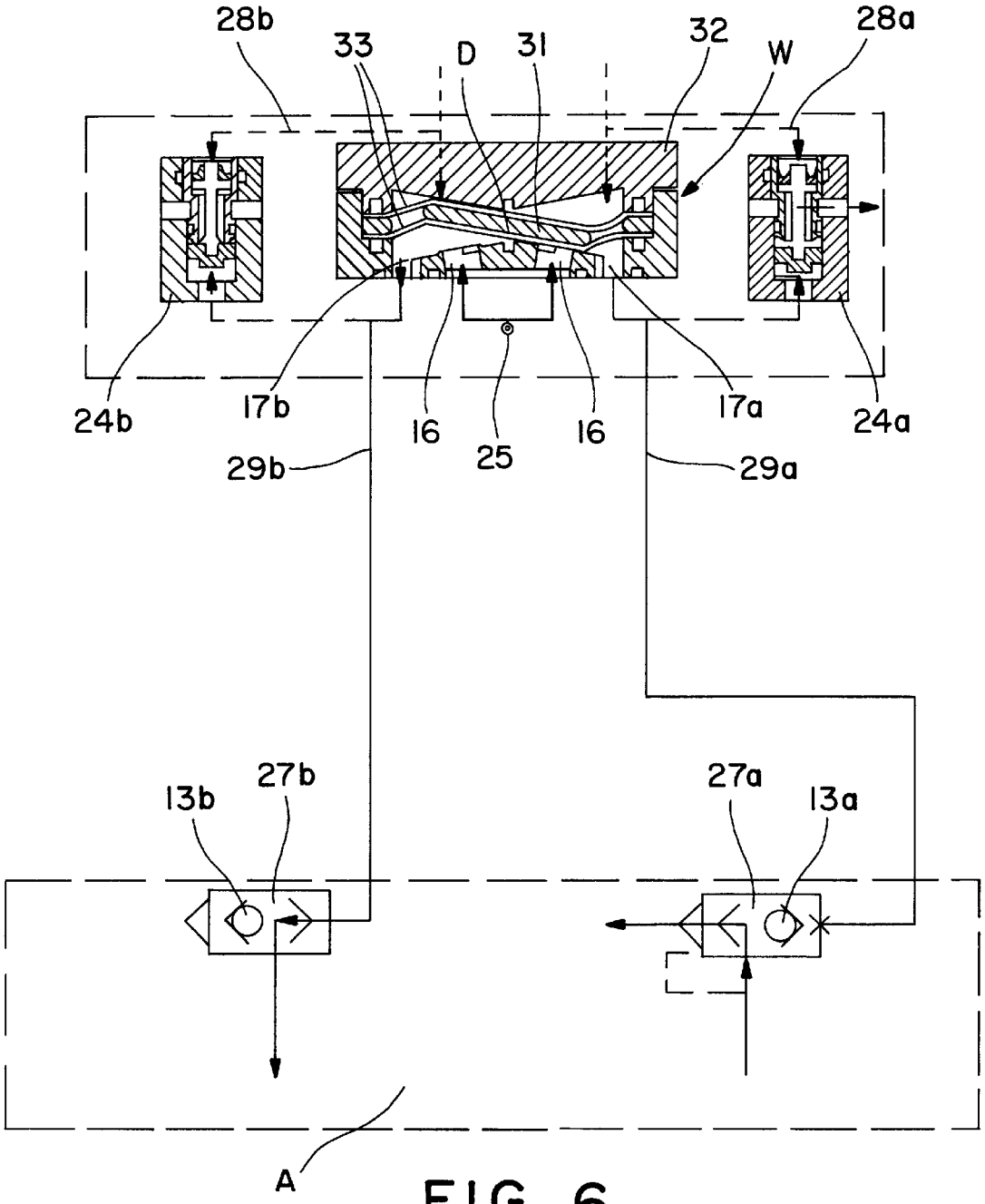
FIG. 6 illustrates a switch valve of a rocker-valve design with corresponding exhaust control valves.

An advantageous version of the switch valve is illustrated in FIG. 6. In this version a rocker valve W is planned as a switch valve. An essentially rigid rocker 31 made from metal, for example, moves around a rotational axis and is placed into a valve housing 32. The rocker 31 is embedded between two elastomer sealing elements 33—preferably re-enforced by fiber at high pressure—for example, and it rotates around the axis D. The housing 32 has a least one supply connector to the connection with the compressed air source 25 and it has also two working connectors from which the pressure lines 29*a*, 29*b* lead to the working cylinder A. Whenever a pre-control pressure of any size is applied to the control line 28*a*, which applies force onto the left section of the rocker 31—which force is greater than the supply pressure on P at the right arm of the rocker and the applied force—then the rocker 31 is moved to the position shown in FIG. 6 together with the elastomer sealing elements 33, which means, a position in which the rocker 31 closes the right valve seat and connects the compressed air source 25 through the left working port to a working chamber of the working cylinder A. The other working port is closed. Since the control line 28*a* also applies pressure on the exhaust control valve 24 with the control pressure, the exhaust control valve opens the connection from the right pressure line 29*a* into the atmosphere and makes the line thereby pressureless, whereby the right exhaust valve 27*a* in the working cylinder also opens and exhausts the corresponding working chamber into the atmosphere.

Figure 7:
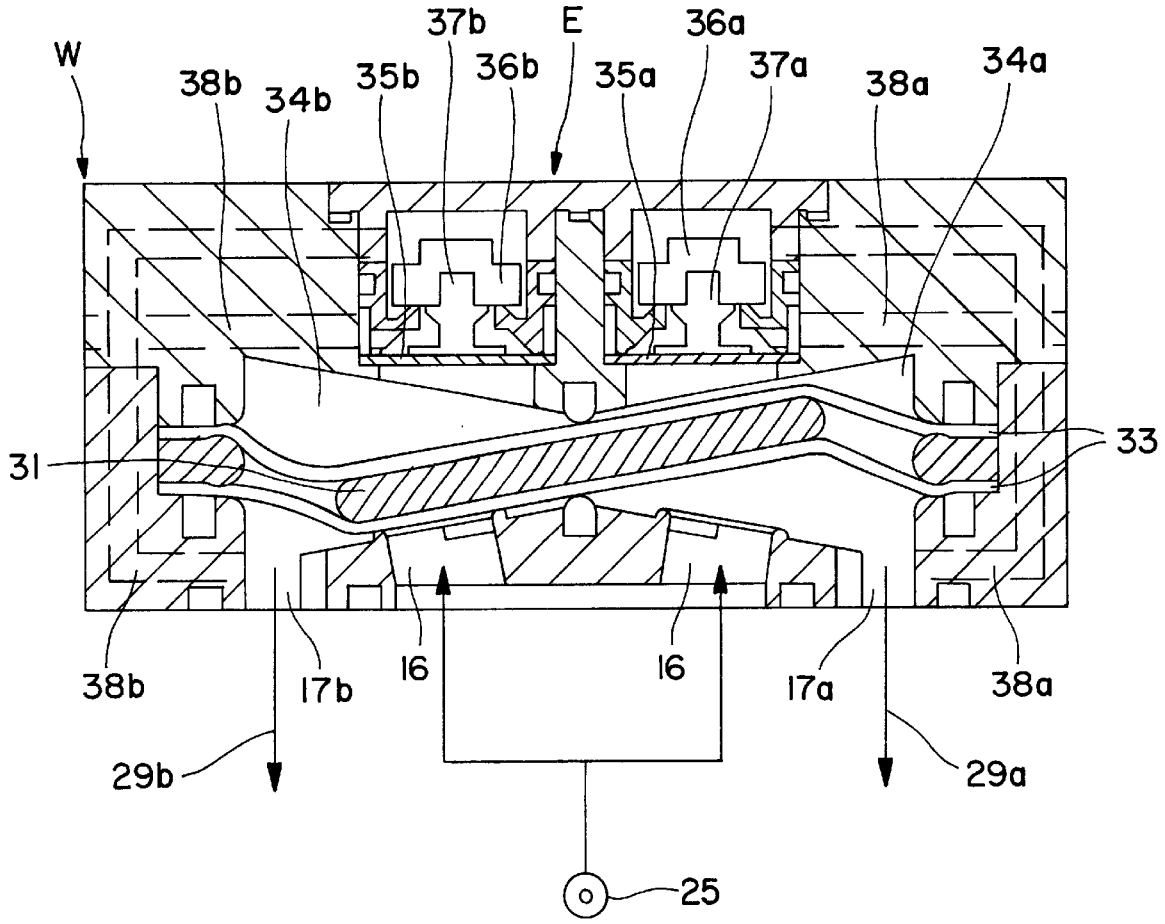
FIG. 7 shows a switch valve of the rocker-valve design that has integrated exhaust control valves.

The version of the rocker switch valve W in FIG. 6 or FIG. 7 is advantageous since it is of small structural dimensions and reaches the goal for a pneumatic working unit with the possibly fewest components. In its housing 32 there is installed an insert E with two exhaust valves. The control areas 34*a*, 34*b* for the actuation of the rocker 31 have a part that is sealed by a flexible membrane 35 and over which membrane 35 the existing pressure in the control room 34*a*, 34*b* is transferred to the exhaust control valves for actuating their sealing elements 36*a*, 36*b*, preferably through the valve shafts 37*a*, 37*b*. From the working connectors to the pressure lines 29*a*, 29*b* there are discharge channels 38*a*, 38*b* that lead past the rocker 31 to the exhaust control valves and continue to the exhaust ports out into the atmosphere. The illustrated position of the rocker switch valve W has pressure applied from the control pressure to the left control area 34*b*, this control pressure would also apply force through the membrane 35*b* and the valve shaft 37*b* and would subsequently lift the valve element 36*b* of the left depressurization control valve from its valve seat and thereby opens the discharge channel 38*b*. The left working port is shut off in this position against the compressed air source 25; however, it is exhausted into the atmosphere through the discharge channel 38*b* and is made pressureless. The right working port of the pressure line 29*a* is connected to the compressed air source 25 and supplies the working chambers of the working cylinder with compressed air. The right exhaust control valve keeps thereby the discharge channel 38*a* in a closed position.

Of course, several or even all mentioned elements of the pressure-actuated working unit may be combined into one single component, whereby great simplification is accomplished for assembly and arrangement at the assembly point. For example, the valve for the control of one or both working chambers or even for double-action working cylinders may have attached a switch valve directly to the working cylinder for the control of both working chambers or the valve may be integrated within the cylinder, preferably in one of the end sections of this cylinder. Even one or each exhaust control valve may be attached in the same manner to the working cylinder and/or the switch valve may be integrated within. Thereby lines are eliminated between the combined components and in case of integration, connections and sealing areas may also be eliminated; whereby, on one hand, the arrangement of the entire system may be considerably simplified and, on the other hand, its operational dependability may be greatly increased based in the lower danger for leakage. The just-mentioned possibilities are also advantageously applicable in the design of the switch valve in its rocker type construction.

An expansion of application possibilities and an increase of possible working functions may be reached by a very compact arrangement, whereby within or on the working cylinder A a control logic arrangement is integrated. This control logic arrangement may be flange-mounted to the working cylinder or may be integrated preferably in one of its end sections. From the central control unit there are connection lines going to this control logic arrangement in or on the cylinder, which are used for communication, electric controls, energy supply and supply of working medium. A field bus is thereby preferably planned as communication system. The control logic arrangement may also analyze placement and position signals, for example, of final positions or placement sensors in or on the working cylinder or elements actuated by the cylinder. The control logic arrangement may also regulate control valves to trigger corresponding actions or it may also send back signals and actions to the control unit through these communication lines.

What is claimed is:

1. A working cylinder which comprises a cylinder barrel, a first end cover at one end of said cylinder barrel, and a movable piston in said cylinder barrel which defines a first working chamber in said cylinder barrel between said piston and said first end cover, said end cover defining a supply port for input of working medium, an exhaust port for discharge of working medium, a first channel for flow of working medium to and from said first working chamber, a second channel for flow of working medium to said exhaust port, and a single valve element which is movable between a first position where said second channel is closed and working medium flows from said inlet port to said first working chamber, and a second position where said second channel is opened and working medium flows from said first working chamber through said first channel to said second channel and out said outlet port.

2. A working cylinder having at least one working chamber defined by a cylinder barrel, at least one end section and a piston, at least one supply port for working medium to flow into said working chamber and an exhaust port for the working medium to exhaust from said working chamber and directly to the outside of said working cylinder, wherein the exhaust port is located on the cylinder and is opened or closed by only one valve which is only controlled by the pressure difference of the working medium being applied at the supply port and the pressure of the working medium in the working chamber.

3. A cylinder according to claim 2, wherein the supply port and the exhaust port are directly connected with one another by a passageway for the working medium and the valve is installed into said passageway.

4. A cylinder according to claim 3, wherein a supply channel extends from the supply port for the working medium to the working chamber and to the exhaust port in parallel to the passageway.

5. A cylinder according to claim 4, wherein the supply channel has a smaller diameter than the passageway to the exhaust port.

6. A cylinder according to claim 2, wherein the exhaust port is topped with a speed throttle element and/or a muffler.

7. A cylinder according to claim 4, wherein the valve has a sealing element which moves freely and covers the passageway and at least partially covers the supply channel.

8. A cylinder according to claim 2, which is designed as a double-action cylinder and is constructed the same way at each end.

9. A cylinder according to claim 7, wherein the sealing element completely covers the supply channel.

* * * * *